United States Patent [19]

Kyono et al.

[11] Patent Number: 4,929,513

[45] Date of Patent: May 29, 1990

[54] PREFORM WIRE FOR A CARBON FIBER REINFORCED ALUMINUM COMPOSITE MATERIAL AND A METHOD FOR MANUFACTURING THE SAME

[75] Inventors: Tetsuyuki Kyono; Seiichiro Ohnishi, both of Shiga; Tohru Hanano, Kyoto; Tohru Hotta, Shiga, all of Japan

[73] Assignee: Agency of Industrial Science and Technology, Tokyo, Japan

[21] Appl. No.: 208,039

[22] Filed: Jun. 17, 1988

[30] Foreign Application Priority Data

Jun. 17, 1987 [JP] Japan ..... 62-149085

[51] Int. Cl.[5] ..... C22C 1/09; B32B 15/14

[52] U.S. Cl. ..... 428/611; 428/614; 164/97

[58] Field of Search ..... 428/608, 614, 629, 611, 428/634, 627, 577; 164/97

[56] References Cited

U.S. PATENT DOCUMENTS

| | | | |
|---|---|---|---|
| 3,553,820 | 1/1971 | Sara | 428/614 |
| 3,571,901 | 3/1971 | Sara | 428/614 |
| 3,720,257 | 3/1973 | Buetler et al. | 428/634 |
| 4,145,471 | 3/1979 | Kendall et al. | 428/614 |
| 4,341,823 | 7/1982 | Sexton et al. | 428/634 |
| 4,452,865 | 6/1984 | Yamatsuta et al. | 428/614 |
| 4,600,661 | 7/1986 | Dohnomoto et al. | 428/614 |
| 4,731,298 | 3/1988 | Shindo et al. | 428/614 |
| 4,804,586 | 2/1989 | Tanaka et al. | 428/614 |
| 4,816,289 | 3/1989 | Komatsu et al. | 423/447.3 |

FOREIGN PATENT DOCUMENTS

| | | | |
|---|---|---|---|
| 58-144441 | 8/1983 | Japan | 164/97. |
| 59-12733 | 3/1984 | Japan . | |
| 61-26737 | 2/1986 | Japan | 428/614 |
| 61-69448 | 4/1986 | Japan . | |
| 61-130439 | 6/1986 | Japan . | |

OTHER PUBLICATIONS

Kenneth G. Kreider, "Metal Matrix Composites", vol. 4, Academic Press, N.Y., 1974, pp. 322–337.

*Failure Modes in Composites IV,* pp. 319–335 (1977).

*ICCM–V,* pp. 609–621 (1985).

*Canadian Aeronautics and Space Journal,* vol. 33, No. 1.

*Journal of Composite Materials,* vol. 4, pp. 492–499 (1970).

"Industrial Material", vol. 26, pp. 41–44, Jul., 1987.

*Primary Examiner*—John J. Zimmerman

*Attorney, Agent, or Firm*—Birch, Stewart, Kolasch & Birch

[57] ABSTRACT

The present invention relates to a high-strength, high-productivity perform wire for a carbon fiber reinforced aluminum composite material, which comprises: a continuous fiber bundle of carbon filaments having a $\frac{2}{3}$-width ranging from 25 to 75 $cm^{-1}$, as measured on the basis of Raman spectroscopy, the $\frac{2}{3}$-width corresponding to $\frac{2}{3}$ of the peak level of a Raman band obtained corresponding to a wave number of about 1,585 $cm^{-1}$, the peak level attributed to $E_{2g}$ symmetric vibration of a graphite structure; one or two materials selected from the group consisting of carbon, silicon carbide, titanium, titanium carbide, boron, and titanium boride, the material(s) covering the individual fibers constituting the continuous fiber bundle; and a matrix consisting essentially of aluminum or aluminum alloy each of which contains 0.1% or less of copper and 0.45% or less of silicon, both by weight based on the weight of matrix, and infiltrated into the continuous fiber bundle.

15 Claims, No Drawings

PREFORM WIRE FOR A CARBON FIBER REINFORCED ALUMINUM COMPOSITE MATERIAL AND A METHOD FOR MANUFACTURING THE SAME

BACKGROUND OF THE INVENTION

1. Field of the Invention

The present invention relates to a preform wire used in manufacturing a carbon fiber reinforced aluminum composite material and a method for manufacturing the same.

2. Description of the Prior Art

Carbon fiber reinforced metal composite materials (hereinafter referred to as carbom/metal composites), which consist essentially of metal, as a matrix, and carbon fibers, as reinforcements, are higher in specific strength and specific modulus than monolithic metal. Therefore, the carbon/metal composites are regarded as promising materials in various fields of industry. Among these materials, the carbon/metal composites whose matrix is formed of aluminum or aluminum alloy, that is, carbon fiber reinforced aluminum composite material (hereinafter referred to as C/Al), is especially high in specific strength and specific modulus. Accordingly, the C/Al is considered a highly promising lightweight structural material for use in various industrial fields, such as in the aerospace industries.

In general, carbon fibers are poor in wettability with molten aluminum or aluminum alloy, while they tend to react easily with aluminum at high temperature, thereby deteriorating their properties. Accordingly, various measures have been taken to improve the wettability and prevent the reaction with aluminum.

In Japanese Patent Publication No. 59-12733, for example, there is a statement that the wettability of carbon fibers can be effectively improved by coating them with titanium boride or a mixture of titanium carbide and titanium boride. According to this method, however, the reaction between the carbon fibers and aluminum cannot be fully prevented. Furthermore, when "Thornel" 300 (manufactured by Union Carbide Co., Ltd., U.S.A.), which is of the so-called high-strength type, is used for the carbon fibers, and when AA202 is used as the aluminum alloy, the tensile strength of the C/Al is only 0.24 GPa when the carbon-fiber content (hereinafter referred to as $V_f$) in the C/Al is 29% (see "Journal of Composite Materials" vol. 10, pp. 279 to 296, October, 1976), due to a reaction given by $$4Al+3C \rightarrow Al_4C_3.$$

In Japanese Patent Disclosure No. 61-69448, on the other hand, there is a statement that if carbon fibers are coated with carbon and then further coated with a material mainly composed of metal carbide or the like, a reaction between the carbo fiber and the aluminum is prevented, and a preform wire with a tensile strength equivalent to 86% of an estimated strength based on the rule of mixture can be obtained. However, the wettability can hardly be improved by the coating of these materials, and it is necessary that the carbon fibers are further coated with a material consisting essentially of titanium or boron. This results in a substantial increase in manufacturing cost, and requires more complicated processes.

Japanese Patent Laid-Open No. 61-130439 discloses a preform wire having a $V_f$ of 50% and a tensile strength of 1.5 GPa, which is composed of a continuous bundle of untreated carbon fibers and is infiltrated with aluminum. These untreated fiber bundles, whose surface is not treated for oxidation, are not highly reactive to aluminum, and have an elastic modulus of 373 GPa or more, in the direction of the fiber axis. Since these untreated carbon fibers with high modulus are less active or have smaller surface energy than those carbon fibers (hereinafter referred to as surface-treated carbon fibers) whose surface is treated for oxidation, the former have an advantage over the latter in being less susceptible to a deteriorative reaction. On the other hand, a material to improve wettability between carbon and aluminum cannot easily adhere to the untreated carbon fibers, so that preform wires obtained with use of these untreated carbon fibers cannot enjoy high productivity.

OBJECTS AND SUMMARY OF THE INVENTION

The principal object of the present invention is to provide a preform wire of C/Al, free from the aforementioned drawbacks of the prior art and having a high specific strength.

Another object of the present invention is to provide a method for manufacturing a high-strength preform wire of C/Al materials having high efficiency and stability.

According to an aspect of the present invention, there is provided a high-strength, high-productivity preform wire for a carbon fiber reinforced aluminum composite material, which comprises: a continuous fiber bundle of carbon filaments having a $\frac{2}{3}$-width ranging from 25 to 75 $cm^{-1}$, preferably 30 to 60 $cm^{-1}$, more preferably 35 to 55 $cm^{-1}$, as measured on the basis of Raman spectroscopy, the $\frac{2}{3}$-width corresponding to $\frac{2}{3}$ of the peak level of a Raman band obtained corresponding to a wave numbe of about 1,585 $cm^{-1}$, the peak level attributed to $E_{2g}$ symmetric vibration of a graphite struture; one or two materials selected from the group consisting of carbon, silicon carbide, titanium, titanium carbide, boron, and titanium boride, the material(s) covering each of the filaments constituting the continuous fiber bundle; and a matrix consisting essentially of aluminum or aluminum alloy each of which contains 0.1% or less of copper, preferably 0.05% or less, more preferably 0.03% or less, and 0.45% or less of silicon, preferably 0.3% or less, more preferably 0.2% or less both by weight based on the weight of the matrix, and infiltrated into the continuous fiber bundle.

Preferably, the iron content and chromium content of the infiltrated aluminum or aluminum alloy are restricted to 0.7% or less and 0.35% or less, respectively, by weight based on the weight of the matrix.

According to another aspect of the present invention, there is provided a method for manufacturing a preform wire for a carbon fiber reinforced aluminum composite material, which comprises: a process for preparing a continuous fiber bundle of carbon filaments having a $\frac{2}{3}$-width ranging from 25 to 75 $cm^{-1}$, as measured on the basis of Raman spectroscopy, the $\frac{2}{3}$-width corresponding to $\frac{2}{3}$ of the peak level of a Raman band obtained corresponding to a wave number of about 1,585 $cm^{-1}$, the peak level attributed to $E_{2g}$ symmetric vibration of a graphite structure; a process for coating each of the filaments constituting the continuous fiber bundle, with a matrix consisting essentially of one or two materials selected from the group consisting of carbon, silicon carbide, titanium, titanium carbide, boron, and titanium boride; and a process for infiltrating the continuous fiber bundle with a matrix consisting essentially of aluminum or aluminum alloy each of which contains 0.1% or less of copper and 0.45% or less of silicon, both by weight based on the weight of the matrix.

As required, the surface of each filament of the continuous fiber bundle is treated for oxidation before the coating process, and the preform wire is heat-treated at 150° to 500° C. after the infiltration process.

The above and other objects, features, and advantages of the invention will be more apparent from the ensuing detailed description.

DETAILED DESCRIPTION

In the present invention, carbon fibers are used in the form of a continuous fiber bundle. The carbon fibers may be of a material derived from polyacrylonitrile, pitch, rayon or the like. Polyacrylonitrile-based carbon fibers are best suited for the purpose, since they can provide a preform wire of the highest specific strength. Moreover, the carbon fibers may be either untreated or surface-treated. The surface-treated carbon fibers can be prepared by a conventional method of surface treatment as follows. For example, the carbon fibers are passed through a 0.01 to 1N water solution of sodium hydroxide, while serving as an anode across which a DC current is caused to flow by means of a current supply roller. The carbon fibers are given energy of 5 to 2,000 C/g (coulomb per gram), preferably 5 to 1,000 C/g, more preferably 5 to 500 C/g. According to the present invention, the carbon fibers used have a $\frac{2}{3}$-width ranging from 25 to 75 $cm^{-1}$, preferably from 30 to 60 $cm^{-1}$, more preferably from 35 to 55 $cm^{-1}$, as measured on the basis of Raman spectroscopy. Here the $\frac{2}{3}$-width is a linewidth which corresponds to $\frac{2}{3}$ of the peak level (intensity) of a Raman band (hereinafter referred to as crystal band) obtained corresponding to a wave number of about 1,585 $cm^{-1}$. This peak level is said to be attributed to $E_{2g}$ symmetric vibration of a graphite structure. By the use of these carbon fibers, a high-strength preform wire can be manufactured stably and efficiently. The peak level of the crystal band is obtained on the basis of the background of a spectrum. The present invention uses these carbon fibers for the following reasons.

In general, a carbon fiber is composed of elongate, ribbon-shaped polynuclear aromatic fragments which, formed of condensed benzene rings, are oriented along the fiber axis. These ribbon-shaped fragments are very high in benzene-ring condensation degree, and can be regarded as ultimate aromatic compounds. They lie one upon another, thereby forming a graphite crystal region (see "Industrial Material" vol. 26, pp. 41 to 44, July, 1978). Thus, the degree of graphitization of carbon fibers and the aforementioned deteriorative reaction have a close relationship to each other. The graphitization degree of carbon fibers is practically determined by the heat-treatment temperature, although it is also influenced by the type of the precursor used and the ductility of the graphitized fibers. Thereupon, the inventors hereof examined the relationship between the graphitization degree and the deteriorative reaction, and found that the deteriorative reaction was greatly influenced by the degree of graphitization at the outer surface region of the carbon fibers. They also found that the graphitization degree was influenced not only by the heat-treatment temperature but also by the level of surface treatment, and that the level of surface treatment well corresponded to the $\frac{2}{3}$-width of the Raman spectroscopy. Further, the inventors surveyed the relationships between the $\frac{2}{3}$-width, the tensile strength of the preform wire, and the production efficiency. As a result, it was revealed that a preform wire with high tensile strength can be manufactured stably and efficiently by using carbon fibers with the $\frac{2}{3}$-width of 25 to 75 $cm^{-1}$.

The use of the aforesaid carbon fibers makes it possible to restrict the ratio in weight between $Al_4C_3$, which is produced in the preform wire during an impregnation process (mentioned later) for aluminum or aluminum alloy, and the carbon fibers, i.e., $Al_4C_3/C$, to a very small value, 0.01 or less. Thus, the tensile strength of the preform wire can hardly be lowered by the aforementioned deteriorative reaction. Moreover, these carbon fibers have surface energy just great enough to permit a coating material for wettability to stick easily to their surfaces, so that the production efficiency of the preform wire is improved considerably. Those carbon fibers whose $\frac{2}{3}$-width exceeds 75 $cm^{-1}$ undergo a drastic deteriorative reaction, so that the tensile strength of the preform wire is extremely low. Those with the $\frac{2}{3}$-width of less than 25 $cm^{-1}$, on the other hand, exhibits a very high degree of graphitization at the surface region, which results in small surface energy. Thus, the adhesion to the coating material is so poor that the production efficiency of the preform wire is very low. The weight ratio $Al_4C_3/C$ is obtained as follows. The preform wire is immersed in 6-N hydrochloric acid, and the methane concentration of the resulting gas is quantitatively analyzed by gas chromatography. Then, the ratio is calculated on the basis of the result of the analysis.

The Raman spectroscopy is a method for obtaining information on the molecular structure of a substance by utilizing the Raman effect. The Raman effect is a phenomenon such that a scattered light beam with a wavelength shifted by a margin peculiar to a substance is observed when a laser beam is applied to the substance. According to the present invention, the spectroscopic analysis is performed in the following manner, by using a laser Raman system "Ramanor" U-1000, produced by Jobin Yvon & Co., Ltd., France. An argon-ion laser of 514.5-nm wvelength is applied to a carbon fiber bundle attached to a holder, in a nitrogen atmosphere, and a Raman-scattered light beam is condensed. Thereafter, the condensed beam is separated into its spectral components by double grating, and their intensity is detected by means of a photo-multimeter. The resulting spectra are measured by the photo counting system and recorded on a chart. The analysis is made on the basis of the $\frac{2}{3}$-width read from the chart.

According to the present invention, each carbon filament out of the continuous fiber bundle is coated with one or more substances selected among the group including carbon, silicon carbide, titanium, titanium carbide, boron, and titanium boride, for higher wettability with aluminum or aluminum alloy. For example, the coating may be performed by the chemical vapor deposition (CVD) method, as is stated in Japanese Patent Publication No. 59-12733, the physical vapor deposition (PVD) method, such as spraying, or other conventional method. In this case, each single filament may be subjected to a two-step coating such that it is coated with a second layer after it is coated with a first layer. The material of the first layer is selected among a group including carbon, silicon carbide, titanium carbide, and boron. The material for the second layer may be titanium or titanium boride. Thus, titanium or titanium boride can be caused to adhere securely, and its wettability with aluminum or aluminum alloy is further enhanced to improve the yield of the preform wire.

Subsequently, a continuous fiber bundle comprising carbon filaments coated with a material to improve wettability is infiltrated with a matrix consisting essentially of aluminum or aluminum alloy, and is solidified to a preform wire. In doing this, the continuous fiber bundle is immersed in molten aluminum or aluminum alloy of 675° C. or less for 60 seconds or less. If the continuous fiber bundle is immersed in a high-temperature molten metal for a longer period of time, aluminum reacts with the carbon fibers, thereby increasing the weight ratio $Al_4C_3/C$ and lowering the translation of strength of the preform wire. In order to restrict the weight ratio $Al_4C_3/C$ to 0.01 or less, the continuous fiber bundle should be infiltrated with aluminum or aluminum alloy under the aforementioned conditions.

The matrix used should be formd of aluminum or aluminum alloy which contains 0.1% or less of copper and 0.45% or less of silicon, both by weight based on the weight of the matrix.

The inventors hereof further examined the interface between the carbon fibers and the matrix, and obtained the following findings. Among chemical ingredients contained in aluminum or aluminum alloy, for use as the matrix material, copper and silicon are highly liable to preferentially form a brittle eutectic structure near the surface of the carbon fibers in the solidifying process for the molten aluminum or aluminum alloy, during the production of the preform wire. The strength of the preform wire is detriorated especially when the carbon fibers used are surface-treated. Preferably, therefore, the quantities of copper and silicon contained in the aluminum or aluminum alloy should be minimized. No problems arise, however, if the copper and silicon contents are 0.1% and 0.45% or less by weight based on the weight of the matrix, respectively. The copper content is preferably 0.05% by weight, and more preferably, 0.03%. The silicon content is preferably 0.3% or less by weight based on the weight of the matrix, and more preferably is 0.2% or less. As for other substances than copper and silicon, iron should preferably be contained at 0.5% or less; manganese, 1.5% or less; magnesium, 6% or less; chromium, 0.35% or less; zinc, 0.25% or less; and titanium, 0.2% or less, all by weight based on the weight of the matrix. If iron, manganese, and chromium are contained more, they react with aluminum to produce brittle intermetallic compounds, thereby lowering the tenacity of the preform wire. Too high a titanium content produces the same results, although a very small amount of titanium provides fine crystal grains. As for magnesium, it can be expected to enhance the heating effect for the preform wire, as mentioned later, and to reduce the specific gravity of the matrix. If it is contained too much, however, magnesium lowers the corrosion resistance of the preform wire. Zinc should be restricted to the aforesaid content level also in consideration of the corrosion resistance.

The preform wire according to the present invention can be obtained in this manner. If the preform wire is heated at 150° to 500° C., preferably 200° to 400° C., more preferably 200° C. to 350° C., its tensile strength will be improved by about 10 to 50%.

Thus, if the $\frac{2}{3}$-width of the carbon fibers used is 25 to 75 $cm^{-1}$, the reduction of the tensile strength of the preform wire, attributable to the reaction between the carbon fibers and aluminum, can be restrained considerably. However, since a small amount of $Al_4C_3$ is produced in the preform wire, although in the ratio of 0.01 or less by weight, the carbon fibers and the matrix can be considered to have been chemically bonded at their interface. Before the heat treatment, therefore, the preform wire is high in notch susceptibility, and is liable to become brittle. If the preform wire is heated to a temperature of 150° to 500° C., however, its tensile strength is improved by 10 to 50%. This is presumably because the residual stress is eased and the strength of chemical adhesion at the interface between the carbon fibers and the matrix is reduced, by the heat treatment, so that the notch sensitivity lowers. In conjunction with the notch sensitivity, each filament more or less has very small defects near its surface from which fracture starts initially. If the chemical bond strength at the fiber/matrix interface in the preform wire is too high, stress concentration easily occur around the defects finally led to catastrophic fracture of the whole preform wire. the susceptibility to small defects mentioned above is reffered to as notch sensitivity of preform wire.

Preferably, the heat treatment time is one hour or more. In order to prevent oxidation of the carbon fibers, moreover, an inert gas atmosphere or vacuum atmosphere should preferably be used as the atmosphere for the heat treatment. If the ambient temperature is 300° C. or less, the heat treatment may be performed in the open air.

The manufacture of C/Al, using the preform wire of the present invention, may be achieved by conventional methods, including the so-called diffusion bonding methods, such as hot pressing, rolling, drawing, HIP (hot isostatic pressing) process, etc., and liquid-phase methods, such as casting.

EXAMPLES

Example 1

A continuous fiber bundle, including 3,000 acrylic filaments, was obtained by wet spinning of a polyacrylonitrile polymer copolymerized with acrylic acid, with the use of dimethyl sulfoxide as a solvent and water as a coagulant.

Then, the continuous fiber bundle was heated for oxidizing in an oxidative atmosphere of 240° C. for 2 hours, and was further carbonized by heating in a nitrogen atmosphere at a temperature of 1,600° to 2,500° C. Thereupon, a continuous bundle of carbon filaments was obtained. Thereafter, energy of 10 to 100 coulombs for 1-g carbon fibers was applied to the continuous fiber bundle by means of a current supply roller, using the fiber bundle as an anode, thereby oxidizing the surface of the fiber bundle. Thus, 5 different continuous bundles of carbon filaments, Nos. 1 to 5 as shown in Table 1, different in $\frac{2}{3}$-width, was obtained.

Subsequently, each of the continuous fiber bundles Nos. 1 to 5 was treated for 1 minute in a vapor mixture of 680° C., containing 3.2% titanium tetrachloride, 2.5% zinc, and 94.3% argon, all by weight, so that each filament was coated with a titanium layer 100 nm thick.

Then, each of the titanium-coated continuous fiber bundles was passed through a molten aluminum alloy (JIS A 1100; equivalent to AA 1100) of 665° C., containing 0.02% copper and 0.2% silicon, both by weight based on the weight of the aluminum alloy. The aluminum alloy was solidified while each fiber bundle was drawn up therefrom. Thereupon, 5 different preform wires, having $V_f$ of about 50% were obtained.

Subsequently, these five preform wires were subjected to tension tests using a drawing speed of 2 mm/min and Autograph AG-500 manufactured by Shimadzu Corporation. Table 1 shows the results of these tests.

TABLE 1

| | Carbon Fibers | | Preform Wire | |
|---|---|---|---|---|
| | No. | ⅔-width ($cm^{-1}$) | Translation of Strength (%) | Yield (%) |
| Control | 1 | 23 | 30 to 85 | 25 |
| | 2 | 25 | 91 to 97 | 95 |
| Invention | 3 | 52 | 87 to 96 | 95 |
| | 4 | 75 | 90 to 95 | 96 |
| Control | 5 | 78 | 40 to 45 | 98 |

As seen from Table 1, preform wires with high yield and high tensile strength can be obtained only with use of carbon fibers whose ⅔-width ranges from 25 to 75 $cm^{-1}$. The yield is defined as yield={(length of preform wire obtained)/(length of continuous carbon fiber bundle)}×100. The translation of strength is given by translation of strength=[(tensile strength of preform wire)/{(tensile strength of continuous carbon fiber bundle)×$V_f$}]×100.

EXAMPLE 2

Those filaments constituting the continuous carbon fiber bundle No3 of Table 1, whose ⅔-width is 52 $cm^{-1}$, were coated with materials shown in Table 2, and were then infiltrated with the aforesaid aluminum alloy (JIS A 1100). Thus, 10 different preform wires with $V_f$ of about 50% were produced. The drawing test was conducted on each of these preform wires in the same manner as aforesaid.

Thereupon, as shown in Table 2, those preform wires with a coating according to the present invention proved high in translation of strength and yield. Other samples, however, hardly have the form of a preform wire.

TABLE 2

| | Coating | | | | Preform Wire | |
|---|---|---|---|---|---|---|
| | No. | 1st Layer (Inner) | 2nd Layer (Outer) | Coating Method | Translation of Strength (%) | Yield (%) |
| Invention | 1 | — | Titanium | CVD | 87 to 96 | 95 |
| | 2 | Carbon | Titanium | CVD | 91 to 97 | 96 |
| | 3 | — | Titanium Boride | CVD | 92 to 98 | 91 |
| | 4 | Silicon Carbide | Titanium Boride | CVD | 87 to 94 | 94 |
| | 5 | Titanium Carbide | Titanium Boride | CVD | 88 to 95 | 92 |
| | 6 | Boron | Titanium | CVD | 93 to 98 | 96 |
| Control | 7 | — | Nickel | Plating | 20 to 25 | 15 |
| | 8 | — | Aluminum | Vacuum Evap. | — | 0 |
| | 9 | — | Copper | Plating | — | 0 |
| | 10 | — | Tantalum | CVD | 20 to 30 | 24 |

EXAMPLE 3

Those filaments constituting the continuous carbon fiber bundle No. 3 of Table 1 were treated for 1 minute in a vapor mixture of 680° C., containing 1.2% boron trichloride, 5.1% titanium tetrachloride, and 93.7% argon, all by weight, so that each filament was coated with a titanium boride layer 30 nm thick.

Then, the titanium-boride-coated continuous fiber bundle was infiltrated with alloys 1 to 6, by mixing pure aluminum and parent alloys Al-Cu and Al-Si, and containing copper and silicon of the contents shown in Table 3. Thus, 6 different preform wires with $V_f$ of about 50% were produced. The drawing test was conducted on each of these preform wires in the same manner as aforesaid. Table 3 shows the results of these tests.

TABLE 3

| | | Content (wt. %) | | Preform Wire | |
|---|---|---|---|---|---|
| | Alloy | Copper | Silicon | Translation of Strength (%) | Yield (%) |
| Invention | Alloy 1 | 0.08 | 0.41 | 92 to 98 | 96 |
| | Alloy 2 | 0.05 | 0.15 | 94 to 98 | 95 |
| | Alloy 3 | 0.01 | 0.07 | 95 to 101 | 97 |
| | Alloy 4 | 0.20 | 0.32 | 50 to 55 | 93 |
| Control | Alloy 5 | 0.08 | 0.61 | 51 to 54 | 94 |
| | Alloy 6 | 0.21 | 0.69 | 47 to 52 | 95 |

Although all the preform wires enjoy high yield, as seen from Table 3, preform wires with high translation of strength can be obtained only with use of aluminum alloys which contain 0.1% or less of copper and 0.45% or less of silicon, both by weight.

Example 4

Those filaments constituting the continuous carbon fiber bundle No. 3 of Table 1 were treated for 1 minute in a vapor mixture of 680° C., containing 1.6% boron trichloride and 98.4% argon, both by weight, so that each filament was coated with a boron layer 20 nm thick. Thereafter, preform wires were obtained with use of the aluminum alloy 3 of Table3, under the conditions shown in Table 4.

As seen from table 4, the preform wire whose the weight ratio $Al_4C_3/C$ exceeded 0.01 proved lower in incidence of strength. Thus, it is to be desired that the weight ratio should be 0.01 or less.

TABLE 4

| | Molten Metal | Immersion | Weight | Translation |
|---|---|---|---|---|
| | Temperature (°C.) | Time (sec) | Ratio $Al_4C_3/C$ | of Strength (%) |
| Invention | 665 | 30 | 0.004 | 92 to 98 |
| | 665 | 60 | 0.009 | 88 to 93 |

TABLE 4-continued

| | Molten Metal Temperature (°C.) | Immersion Time (sec) | Weight Ratio $Al_4C_3/C$ | Translation of Strength (%) |
|---|---|---|---|---|
| Control | 700 | 60 | 0.013 | 45 to 50 |

What is claimed is:

1. A preform wire for manufacturing a carbon fiber reinforced aluminum composite material comprising:

a continuous fiber bundle of carbon filaments having a $\frac{2}{3}$-width ranging from 25 to 75 $cm^{-1}$, as measured on the basis of Raman spectroscopy, said $\frac{2}{3}$-width corresponding to $\frac{2}{3}$ of the peak level of a Raman band obtained corresponding to a wave number of about 1,585 $cm^{-1}$, said peak level attributed to $E_{2g}$ symmetric vibration of a graphite structure;

one or two materials selected from the group consisting of carbon, silicon carbide, titanium, titanium carbide, boron, and titanium boride, said one or two materials covering each of the filaments constituting said continuous fiber bundle; and a matrix consisting essentially of aluminum or aluminum alloy each of which contains not more than 0.1% of copper and not more than 0.45% of silicon, both based by weight on the weight of the matrix, and infiltrated into said continuous fiber bundle.

2. The preform wire according to claim 1, wherein said bandwidth ranges from 30 to 60 $cm^{-1}$.

3. The preform wire according to claim 1, wherein said bandwidth ranges from 35 to 55 $cm^{-1}$.

4. The preform wire according to claim 1, wherein the copper content is not more than 0.05%, by weight.

5. The preform wire according to claim 1, wherein the copper content is not more than 0.03%, by weight.

6. The preform wire according to claim 1, wherein the silicon content is not more than 0.03%, by weight.

7. The preform wire according to claim 1, wherein the silicon content is not more than 0.2%, by weight.

8. The preform wire according to claim 1, wherein the iron content and chromium content of said aluminum or aluminum alloy are restricted to not more than 0.5% and not more than 0.35%, respectively, by weight based on the weight of the matrix.

9. The preform wire according to claim 1, wherein the ratio of $Al_4C_3$ to carbon, by weight, is not more than 0.01.

10. The preform wire according to claim 1, wherein said carbon fiber is derived from a material selected from the group consisting of polyacrylonitrile, pitch and rayon.

11. The preform wire according to claim 1, further comprising 0.5% or less iron, 1.5% or less manganese, 6% or less magnesium, 0.35% or less chromium, 0.25% or less zinc, or 0.2% or less titanium based by weight on the weight of the matrix.

12. A method for manufacturing a preform wire for a carbon fiber reinforced aluminum composite material, which comprises the steps of:

(i) preparing a continuous fiber bundle of carbon filaments having a $\frac{2}{3}$-width ranging from 25 to 75 $cm^{-1}$, as measured on the basis of Raman spectroscopy, said $\frac{2}{3}$-width corresponding to $\frac{2}{3}$ of the peak level of a Raman band obtained corresponding to a wave number of about 1,585 $cm^{-1}$, said peak level attributed to $E_{2g}$ symmetric vibration of a graphite structure;

(ii) coating each of the filaments constituting said continuous fiber bundle, with one or two materials selected from the group consisting of carbon, silicon carbide, titanium, titanium carbide, boron, and titanium boride; and (iii) infiltrating said continuous fiber bundle with a matrix consisting essentially of aluminum or aluminum alloy each of which contains not more than 0.1% of copper and not more than 0.45% of silicon, both based by weight on the weight of the matrix.

13. The manufacturing method according to claim 10, wherein the surface of each of the filaments of said continuous fiber bundle is treated for oxidation before said process for coating.

14. The manufacturing method according to claim 12, further comprising a process for heat treatment at 150° to 500° C. after said process for infiltrating.

15. The manufacturing method according to claim 12, wherein in step (iii) the continuous fiber bundle is immersed in molten aluminum or aluminum alloy of 675° C. or less for 60 seconds or less.

* * * * *